United States Patent [19]

Gary

[11] Patent Number: 4,851,977

[45] Date of Patent: Jul. 25, 1989

[54] BRACKET FOR DECORATIVE LIGHTING

[75] Inventor: Lonnie F. Gary, Lubbock, Tex.

[73] Assignee: Gary Products Group, Inc., Lubbock, Tex.

[21] Appl. No.: 229,563

[22] Filed: Aug. 5, 1988

[51] Int. Cl.[4] ..... F21V 21/00

[52] U.S. Cl. ..... 362/249; 362/432; 362/145; 248/315

[58] Field of Search ..... 362/145, 152, 249, 432, 362/457, 382, 306, 396, 234, 253, 458, 430, 151, 147; 248/314, 315, 48.1, 48.2, 309.1, 300; D26/138, 140; 211/70.6, 70.1, 26, 89

[56] References Cited

U.S. PATENT DOCUMENTS

| | | | |
|---|---|---|---|
| 1,719,715 | 7/1929 | Monk | 362/382 |
| 2,269,589 | 1/1942 | Kaufman | 362/806 |
| 2,723,818 | 11/1955 | Hurtzig | 248/315 |
| 3,182,944 | 5/1965 | Laviano | 248/315 |
| 3,189,310 | 6/1965 | Trueson | 362/249 |
| 3,291,428 | 12/1966 | Sisulak | 240/300 |
| 3,341,699 | 9/1967 | Somermeyer | 362/145 |
| 3,540,687 | 11/1970 | Cuva | 362/249 |
| 3,861,632 | 1/1975 | Siilats | 362/432 |
| 3,883,926 | 5/1975 | Reynolds | 362/432 |
| 3,970,837 | 7/1976 | Helm | 362/249 |
| 4,184,592 | 1/1980 | Howard, Jr. | 211/70.1 |
| 4,254,595 | 3/1981 | Crosslen | 248/48.1 |
| 4,491,902 | 1/1985 | Cangelosi | 362/389 |
| 4,570,888 | 2/1986 | Evans | 248/231.9 |
| 4,795,121 | 1/1989 | Comito | 362/382 |

*Primary Examiner*—Ira S. Lazarus
*Assistant Examiner*—D. M. Cox
*Attorney, Agent, or Firm*—Ross, Howison, Clapp & Korn

[57] ABSTRACT

Apparatus and method for installing and displaying exterior decorative lighting on a roof structure. The apparatus comprises a generally L-shaped bracket having an aperture for receiving a decorative bulb which is then operatively coupled to a socket in a string of decorative lights. The bracket is installed by inserting its base between shingles or other overlapping layers of a roof structure, and is maintained there by frictional engagement until manually removed.

3 Claims, 3 Drawing Sheets

BRACKET FOR DECORATIVE LIGHTING

TECHNICAL FIELD

This invention relates to devices useful for installing and displaying decorative lighting, and more particularly, to a bracket adapted to support a decorative light. One aspect of the invention relates to a plastic or metal bracket that will support a decorative light, and can be installed without screws, nails, or other hardware. Another aspect of the invention relates to a mounting bracket for decorative lighting that is itself supported by frictional engagement with a support structure.

BACKGROUND OF THE INVENTION

The use of decorative lighting, and particularly exterior decorative lighting, on residences and businesses is well known. A major portion of exterior decorative lighting is seasonal in nature, such lighting being installed primarily during holiday periods and then removed once the holiday period has passed. Decorative lights are typically purchased in "strings" in which a large number of individual sockets are wired together, and bulbs, frequently colored, are inserted into each socket. Plugs are provided at one or both ends for connection with other light strings or to an electrical power source.

The present invention is directed to deficiencies that have been encountered with devices previously used to install and display decorative lighting. In the past, exterior decorative lights have sometimes been installed by stapling light strings onto the eaves or fascia of a building. Stapling often causes wires to be severed during installation, however, and leaves unattractive holes in the support surface when the decorative lighting and staples are removed. Threaded hooks have also been used to support light strings in the past, but the hooks themselves are difficult to install, and do not secure the bulbs or sockets in a preferred orientation.

Some have disclosed brackets for use in supporting decorative light sockets. Such brackets are shown, for example, in U.S. Pat. Nos. 3,189,310; 3,692,993; 4,128,863; and 4,714,219. The devices shown in these patents, however, require the use of a nail or threaded fastener to install the bracket on the underlying support structure.

Others have disclosed brackets for use with decorative lighting that do not require nails or threaded fasteners for installation, but rather, are adapted to hang from a gutter or eaves trough. Such brackets are disclosed, for example, in U.S. Pat. Nos. 3,599,918 and 3,861,632. Light display means employing magnets are similarly disclosed in U.S. Pat. No. 3,275,818.

SUMMARY OF THE INVENTION

According to the present invention, a bracket useful for displaying decorative lighting is provided that does not require the use of nails, threaded fasteners, gutters or magnets in order to install such lighting on the exterior rooflines of residences or many other buildings. The brackets disclosed herein permit quick and efficient installation of decorative lighting. The brackets disclosed herein will uniformly support decorative light sockets and bulbs in a preferred orientation for attractive display on the exterior of many buildings. The brackets disclosed herein permit decorative lighting to be removed quickly without damage to the underlying support structure of the building. The brackets disclosed herein can be reused repeatedly with different decorative light strings.

According to a preferred embodiment of the invention, a bracket for decorative lighting is provided that comprises a base adapted to be inserted between overlapping shingles on a building having a shingle roof.

According to another preferred embodiment of the invention, a bracket for decorative lighting is provided that comprises an aperture adapted for use with decorative bulbs of different sizes.

According to another preferred embodiment of the invention, a method for installing decorative lighting is provided that comprises the steps of providing a bracket as disclosed herein; inserting the base of a decorative light bulb through the aperture in the bracket and then into the open end of a bulb socket disposed immediately behind the aperture; operatively engaging the base of the decorative bulb and the bulb socket; and thereafter inserting the base of the subject bracket between overlapping layers of a roof structure.

BRIEF DESCRIPTION OF THE DRAWINGS

The present invention is further described and explained in relation to the following drawings wherein.

Like reference numerals are used to indicate like parts in all figures of the drawings.

DESCRIPTION OF THE PREFERRED EMBODIMENTS

Figure 1:
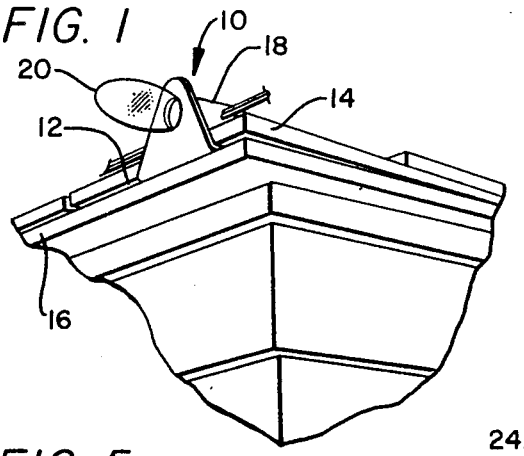
FIG. 1 is a perspective view depicting decorative lighting installed and displayed on the roofline of a building by means of the decorative lighting support bracket of the invention.
Figure 2:
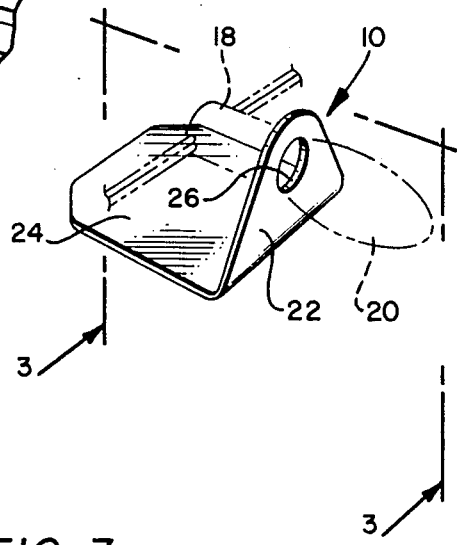
FIG. 2 is a perspective view depicting one embodiment of the decorative lighting support bracket of the invention (with a decorative light bulb, socket and wire shown in phantom) apart from any support structure.
Figure 5:
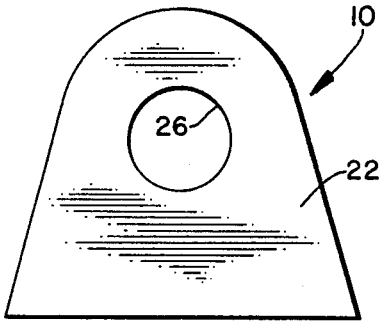
FIG. 5 is a front elevational view of the decorative lighting support bracket of FIG. 2.
Figure 3:
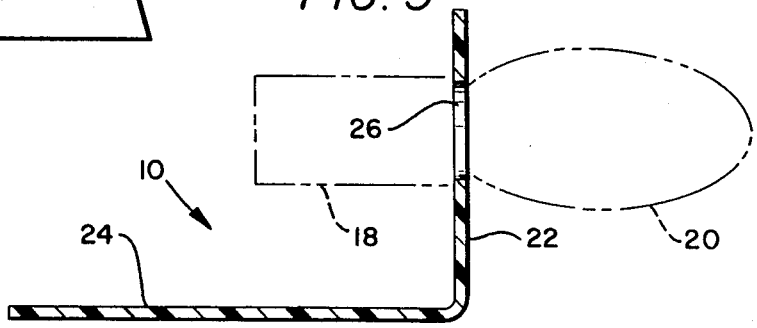
FIG. 3 is a sectional side elevational view of the subject invention taken along line 3—3 of FIG. 2.

As installed in FIG. 1, decorative lighting support bracket 10 preferably supports, maintains and displays a decorative light set comprising socket 18 and bulb 20 in substantially fixed relation to shingle 14 and decking 16 of a building roof structure. Referring to FIGS. 1 through 3 and 5, decorative lighting support bracket 10 of the invention preferably comprises bracket base end member 24 (disposed proximally to the roof when installed), bracket face portion 22 (disposed distally from the proximal end member), and at least one aperture 26 disposed in bracket face portion 22.

The decorative light is desirably connected to bracket 10 by inserting the base of bulb 20 through aperture 26 and then into socket 18 disposed on the opposite side of bracket face portion 22 therefrom. When bracket 10 is to be installed as shown in FIG. 1, bulb 20 desirably faces away from the proximal end of bracket base end member 24. With most commercially available decorative light sets, the base (not shown) of bulb 20 is adapted to threadedly engage socket 16, although some sets may rely on unthreaded frictional engagement between socket 18 and bulb 20.

Once socket 18 and bulb 20 are connected to bracket 10, or prior thereto if preferred, bracket base 24 is desirably inserted between adjacent abutting or overlapping layers of building materials such as shingle 14 and decking 16 in FIG. 1. Depending upon the construction of the particular building with which brackets 10 are utilized, bracket base 24 can also be inserted between adjacent layers of other building materials as well. Thus, for example, the decorative light support brackets of the invention can be similarly inserted between composition shingles, between cedar shakes, between roof decking and fascia boards, or between other facing and opposed building materials where manual force is sufficient to insert bracket base 24 therebetween, and where the resultant frictional engagement between the top and bottom surfaces of bracket base 24 and the building materials facing and contacting such surfaces is sufficient to maintain the desired positional relationship of bracket base 24, once inserted, with respect thereto.

According to one preferred embodiment of the invention, bracket 10 is injection molded from a polymeric resin such as polypropylene or impact grade polystyrene, with bracket base 24 and bracket face 22 each having a thickness of about 1/16 inch (0.16 cm). However, it will become apparent to one of ordinary skill in the art upon reading this disclosure that devices within the scope of the invention can also be made of other plastics, or of metal such as aluminum or galvanized sheet. Also, while injection molding is a satisfactory method of manufacture with a moldable polymeric resin, it will be understood that the subject devices can also be made by extruding or thermoforming the desired shape and thereafter trimming or punching a desired to obtain the final configuration.

Figure 4:
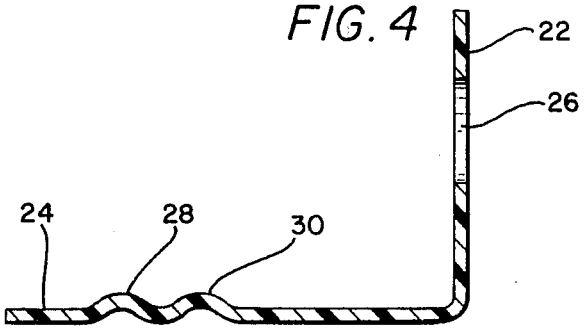
FIG. 4 is a sectional side elevational view of another embodiment of the decorative lighting support bracket of the invention.

Referring to FIG. 4, according to another embodiment of the invention, undulations 28, 30 or other similarly useful surface texturing or variations can be employed to increase or enhance the frictional engagement between bracket base 24 and the building material surfaces with which its major surfaces are in contact. Such undulations should not, however, be so great as to increase the thickness of bracket base 24 beyond the limits than will enable bracket base 24 to be installed or removed through the application of reasonable manual force.

Figure 6:
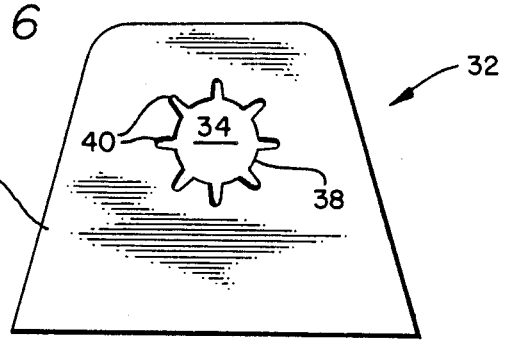
FIG. 6 is a front elevational view of another embodiment of the decorative lighting support bracket of the invention.

Referring to another embodiment of the invention as shown in FIG. 6, bracket face portion 36 of bracket 32 comprises aperture 34 having a plurality of notches 40 separated by webs 38. When aperture 34 is configured as shown in FIG. 6, and is made of a material sufficiently flexible to permit webs 38 to be deformed by inserting a decorative bulb therethrough, aperture 34 will accommodate decorative bulbs of different sizes.

Figure 7:
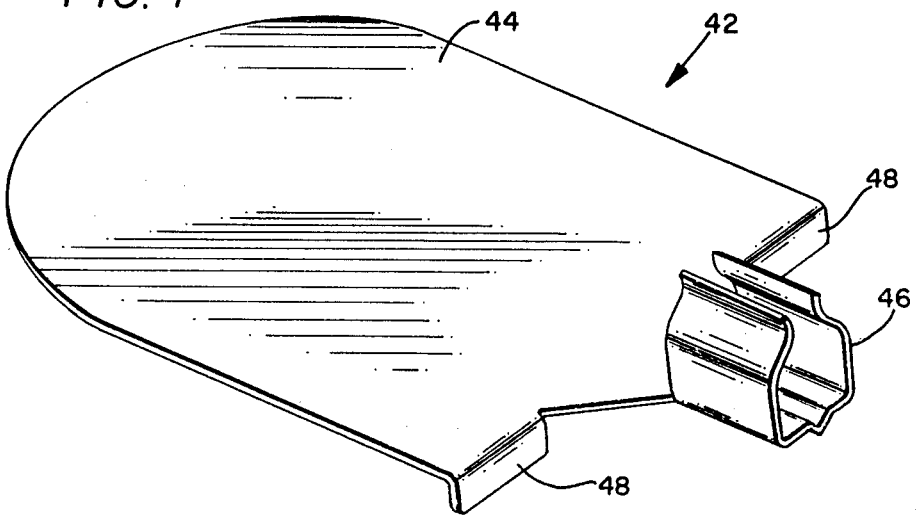
FIG. 7 is a perspective view of another embodiment of the decorative lighting support bracket of the invention.

Referring to FIG. 7, decorative bulb support device 42 is another embodiment of the invention that comprises elongate base member 44 and bulb retainer clip 46. Device 42 is preferably constructed from sheet metal, and tabs 48 are provided to limit the distance base member 44 can be inserted between adjacent layers of building materials during installation.

Figure 8:
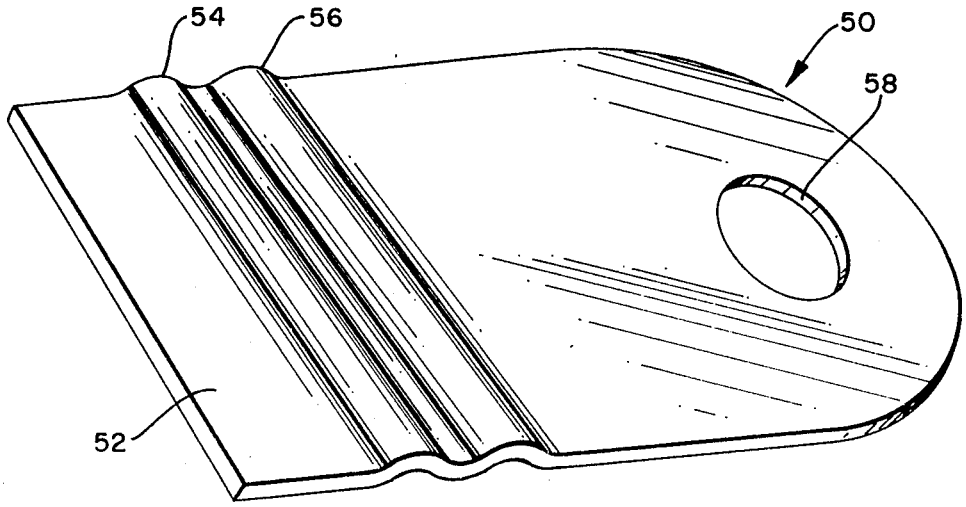
FIG. 8 is a perspective view of another embodiment of the decorative lighting support bracket of the invention.

Yet another embodiment of the invention is disclosed in FIG. 8, wherein bracket 50 comprises elongate base member 52 having surface undulations 54, 56 disposed therein. At least one aperture 58 of suitable diameter is provided for insertion of a decorative bulb therethrough and connection to a socket disposed on the opposite side thereof.

Figure 9:
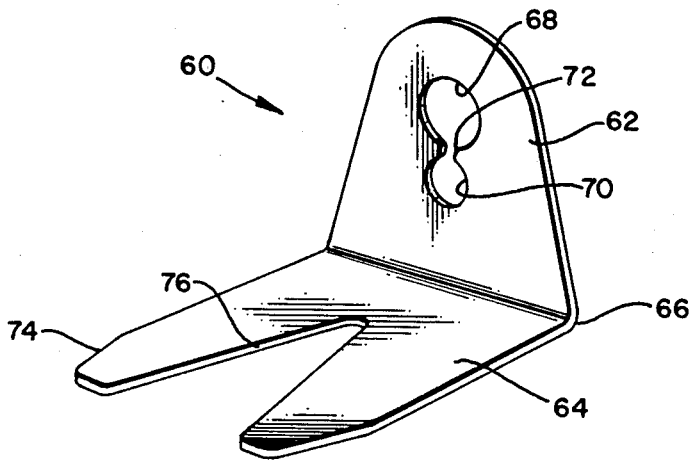
FIG. 9 is a perspective view of another embodiment of the decorative lighting support bracket of the invention.

A particularly preferred embodiment of the invention is shown in FIG. 9, and is further described in relation thereto. Referring to FIG. 9, bracket 60 preferably comprises elongate proximal bracket base member 64 and bracket face portion 62 joined along fold line 66. Although the included angle between base member 64 and face portion 62 can vary within the scope of the invention, an included angle of about 90 degrees has proved to be satisfactory for supporting and displaying decorative lights on residential roofs having roofs with commonly encountered pitches. Tapers 74 are provided to assist insertion of base member 64 between adjacent layers of building materials such as shingles disposed along a roofline, and notch 76 is provided to accommodate any fastening device utilized in applying such building materials that might otherwise interfere with the use or placement of the subject brackets. A dual diameter aperture comprising segments 68, 70 separated by opposed shoulders 72 is preferably provided in bracket face portion 62 to accommodate decorative bulbs in two commonly encountered commercially available sizes. Because of the presence of shoulder 72, a decorative light having a relatively small diameter base can be used with aperture 70 in bracket 60 without falling through the larger diameter segment 68.

Other alterations and modifications of the subject invention will become obvious to those of ordinary skill in the art upon reading this disclosure, and it is intended that the present invention be limited only by the broadest interpretation of the appended claims to which the inventor may be legally entitled.

What is claimed is:

1. A decorative light support device adapted to support and display a decorative light bulb having a socket connected thereto, said device comprising an elongate proximal end member adapted to be inserted between adjacent and overlapping layers of a building roof structure by the application of manual force and thereafter to maintain said device and said bulb in substantially fixed relation to said building roof structure solely by frictional contact between said proximal end member and said layers, said proximal end member further comprising top and bottom surfaces adapted to frictionally engage said adjacent and overlapping layers to restrict movement therebetween pending the reapplication of manual force in substantially the opposite direction, said device further comprising a distal end portion having disposed therein at least one aperture having a diameter large enough to receive the base portion of a decorative light bulb therethrough before said light bulb is connected to said socket and small enough to prevent the connected light bulb and socket from passing therethrough, said proximal end member further comprising means for increasing the frictional engagement between said member and said adjacent and overlapping layers.

2. A decorative light support device adapted to support and display a decorative light bulb having a socket connected thereto, said device comprising an elongate proximal end member adapted to be inserted between adjacent and overlapping layers of a building roof structure by the application of manual force and thereafter to maintain device and said bulb in substantially fixed relation to said building roof structure solely by frictional contact between said proximal end member and said layers, said proximal end member further comprising top and bottom surfaces adapted to frictionally engage said adjacent and overlapping layers to restrict movement therebetween pending the reapplication of manual force in substantially the opposite direction, said device further comprising a distal end portion having disposed therein at least one aperture having a diameter large enough to receive the base portion of a decorative light bulb therethrough before said light bulb is connected to said socket and small enough to prevent the connected light bulb and socket from passing therethrough, said distal end portion further comprising a plurality of apertures of different sizes.

3. A decorative light support device adapted to supported and display a decorative light bulb having a socket connected thereto, said device comprising an elongate proximal end member adapted to be inserted between adjacent and overlapping layers of a building roof structure by the application of manual force and thereafter to maintain said device and said bulb in substantially fixed relation to said building roof structure solely by frictional contact between said proximal end member and said layers, said proximal end member further comprising top and bottom surfaces adapted to frictionally engage said adjacent and overlapping layers to restrict movement therebetween pending the reapplication of manual force in substantially the opposite direction, said device further comprising a distal end portion having disposed therein at least one aperture having a diameter large enough to receive the base portion of a decorative light bulb therethrough before said light bulb is connected to said socket and small enough to prevent the connected light bulb and socket from passing therethrough, said aperture in said distal end portion further comprising at least two adjacent segments having different diameters and having inwardly extending shoulders disposed therebetween to partially occlude said aperture.

* * * * *